United States Patent [19]

Faust

[11] 3,954,177

[45] May 4, 1976

[54] CONTAINER PACKAGE HAVING INTEGRAL MEANS FOR CARRYING

[75] Inventor: Clifford C. Faust, Riverside, Ill.

[73] Assignee: Union Carbide Corporation, New York, N.Y.

[22] Filed: Feb. 8, 1974

[21] Appl. No.: 440,778

[52] U.S. Cl. ..... 206/432; 206/45.33; 206/497; 229/52 B; 229/DIG. 12

[51] Int. Cl.[2] ..... B65D 5/46; B65D 65/16; B65D 71/00; B65D 85/62

[58] Field of Search ..... 206/432, 497, 45.33, 206/427, 526, 419; 220/94 A; 229/55, 54, DIG. 12, 52 B; 215/1 C, 1 R; 53/14, 30 S

[56] References Cited

UNITED STATES PATENTS

| | | | |
|---|---|---|---|
| 2,952,353 | 9/1960 | Rohdin | 206/419 |
| 3,087,610 | 4/1963 | Kirkpatrick | 206/432 |
| 3,200,944 | 8/1965 | Rapata | 206/432 |
| 3,206,020 | 9/1965 | Billingsley et al. | 206/432 |
| 3,277,628 | 10/1966 | Harrison | 53/30 S |
| 3,308,997 | 3/1967 | Kelly | 220/94 A |
| 3,476,237 | 11/1969 | Kirby, Jr. | 206/45.33 |
| 3,695,426 | 10/1972 | Engelsberger | 229/DIG. 12 |
| 3,812,962 | 5/1974 | Cunningham | 206/432 |
| 3,815,313 | 6/1974 | Heisler | 53/14 |

*Primary Examiner*—William T. Dixson, Jr.
*Attorney, Agent, or Firm*—Franklyn Schoenberg

[57] ABSTRACT

A multi-pack container package is provided comprising at least two containers arranged in a substantially abutting array and a flexible plastic film about and retaining said array of containers, said film having upper end portions thereof infolded to form integral finger grip pockets for grasping and carrying the package.

10 Claims, 13 Drawing Figures

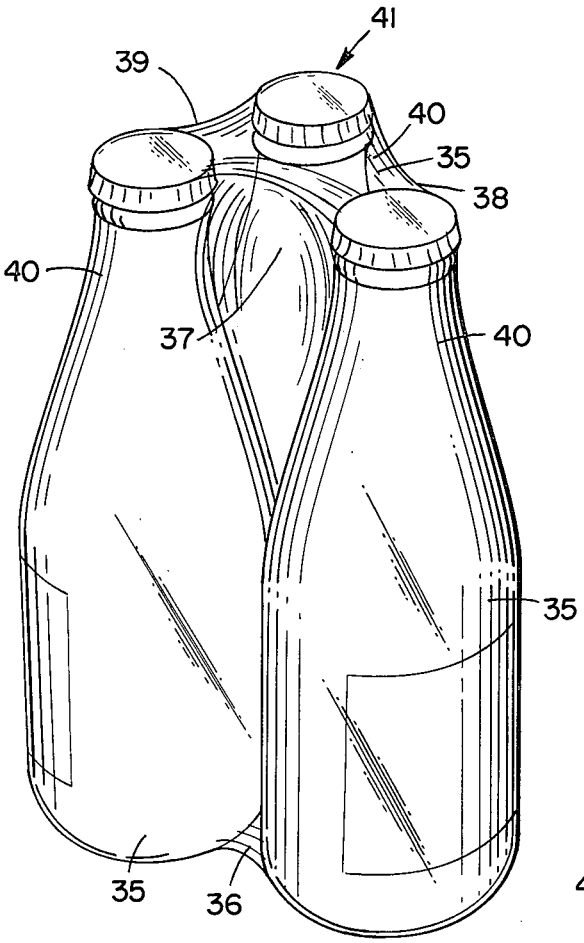
FIG. 5
FIG. 4
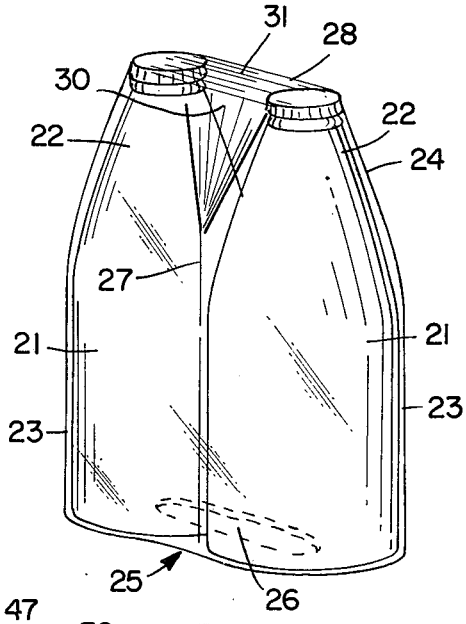
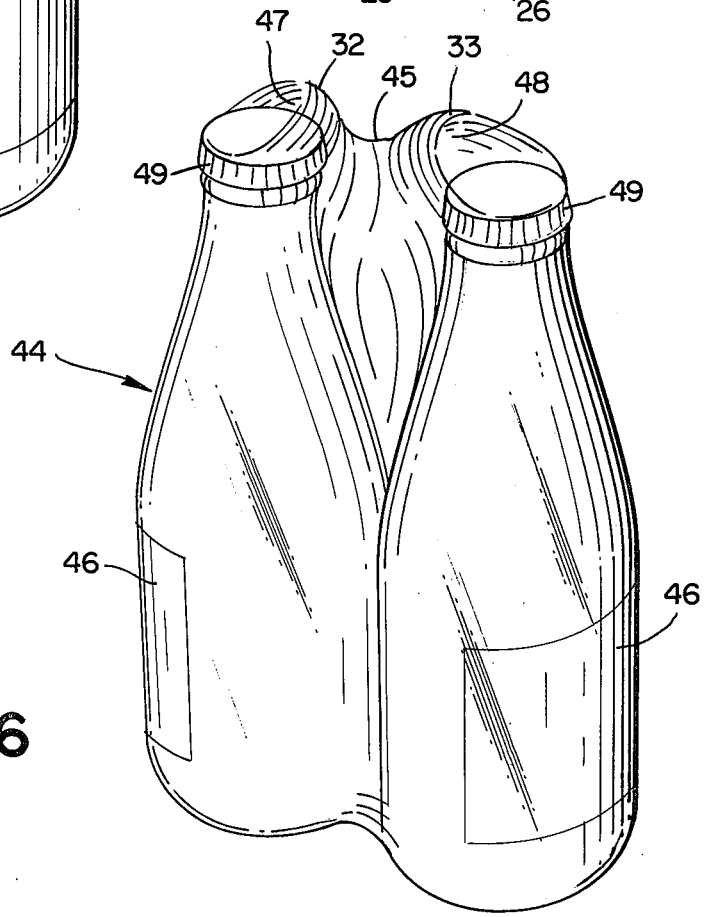
FIG. 6

FIG. 8
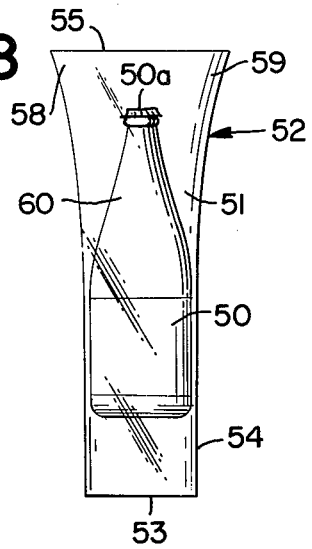
FIG. 9
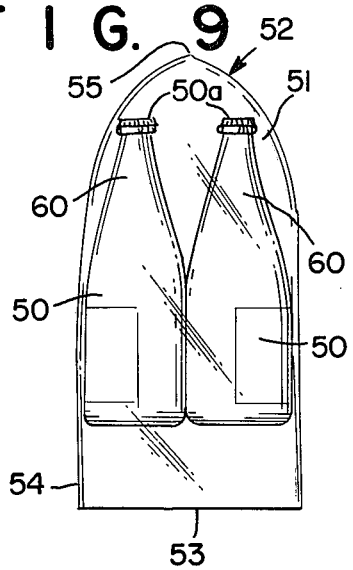
FIG. 7
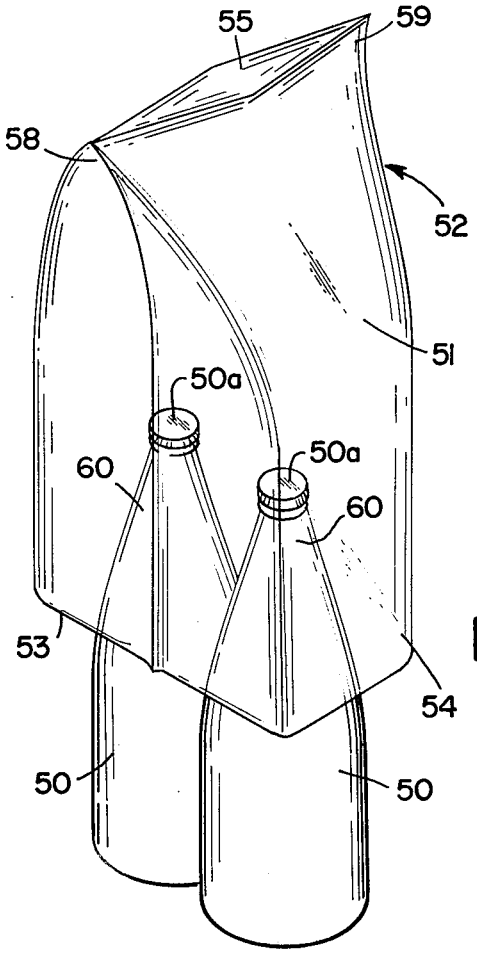
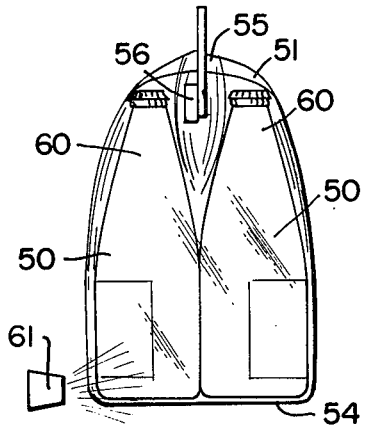
FIG. 10
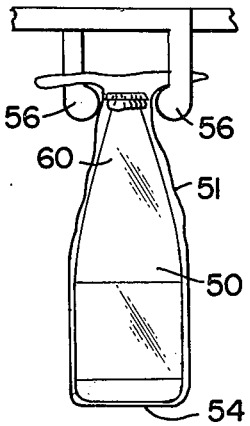
FIG. 11
FIG. 12
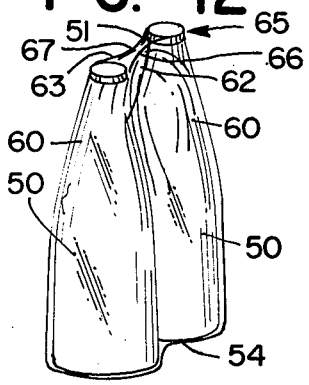
FIG. 13
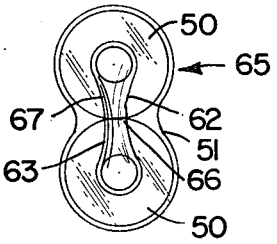

CONTAINER PACKAGE HAVING INTEGRAL MEANS FOR CARRYING

The present invention relates to an improved package construction and more particularly to an improved multi-pack container package construction having integral reinforced means for grasping and carrying the package.

Multi-pack carriers have become widely used in the packaging of products sold in individual containers such as cans, bottles and the like. In general, both the containers and the packages in which they are marketed are disposable. The expendibility of the package makes the cost thereof especially important, yet there should be no sacrifice in package appearance, strength, protection for the containers in the package or the ease for carrying and use.

It is common practice for the packages to be made up to include a handle or other means to facilitate carrying the package. Multi-pack carriers of carton-board box structures having a central handle are widely used but the cost thereof is quite high. Plastic sheet carriers have achieved success in the multi-packaging of beverage cans but the standards for containers such as bottles require that the containers be held and retained in such a manner in the package that they will not be subject to breakage during handling thereof. Heat-shrinkable plastic film that shrinks about members disposed within the film to tightly compact the articles together in a predetermined arrangement has also been successfully employed in formation of packages of containers such as cans. However, when means, such as finger holes and the like, are incorporated in the film package for grasping and carrying the package, a film thickness of 0.003 to 0.005 inch or even thicker is needed to prevent the film from tearing or supplementary reinforcing means must be employed.

There have been several recommendations as to multipackaging devices for containers such as glass bottles, some examples of which are shown in U.S. Pat. Nos. 3,084,792; 3,086,651; 3,330,408; 3,400,810; 3,504,790; 3,541,753. In general, the multi-pack constructions that are known have been found to be satisfactory for particular applications but are complex and expensive to produce and are generally limited as to the sizes and types of containers that may be packaged.

In accordance with the present invention, there is provided a package comprising at least two containers arranged in a substantially abutting array, preferably each of said containers having an upper end portion of smaller cross-section, and a flexible plastic film about and retaining said array of containers with opposite upper end portions of said film being infolded, preferably between the upper end portions of at least two abutting articles, whereby integral reinforced finger grip pockets are formed for grasping and carrying said package. In an especially preferred embodiment, a portion of the infolded film is fused together to afford even greater strength to said finger grip pockets.

There is also provided in accordance with the present invention a method for preparing a package of articles comprising (a) arranging at least two containers, preferably each having an upper end portion of smaller cross-section, in an abutting array; (b) enveloping and retaining said array of containers with a flexible plastic film, the edges of said film extending beyond said array of articles; and then (c) infolding opposite upper end portions of said plastic film, preferably between the upper end, smaller cross-section portions of at least two abutting containers, whereby an integral reinforced finger grip is formed for grasping and carrying the package. Preferably, the plastic film is heated to shrink the same about the containers in said array and it is especially preferred to fuse overfolded portions of the infolded film together.

The method of the present invention is suitable for readily assembling an array of containers such as, for example, various types of glass and plastic bottles, paper and cardboard cartons and cylindrical cans into an attractive, stabilized, multi-pack construction having a reinforced integral gripping and carrying means that may be prepared without preformed spacers or support members for the articles or the need for supplementary carrying means, although separating means may be used where desired for certain applications. The method of the invention is especially advantageous for preparing a package of large containers such as the "family size" soft drink bottles containing 48 fluid ounces or more of beverage.

The package of the present invention is of simple and economical construction that may be prepared using flexible plastic flim as thin as 0.001 inch, yet is strong, protects articles packaged therein and provides reinforced integral means for grasping and carrying the package. Further, articles and particularly containers of a wide variety of sizes, weights and shapes assembled in varying arrays may be packaged, and using a transparent plastic film for the package may eliminate the need for additional advertising printing.

In view of the wide variety of sizes and shapes of containers that may be packaged in accordance with the practice of the present invention, the configuration of said containers and particularly the configuration defining the upper end portion thereof may likewise vary widely in shape and portion defined thereby. As employed throughout this specification and in the appended claims, it should be understood that the term "neck portions" is intended to define an "upper end portion of smaller cross-section" of the containers that are advantageously employed in the package of the present invention.

The package and method of the present invention will become apparent from the following description thereof when considered together with the accompanying drawing which is set forth as being exemplary of various embodiments of the present invention and is not intended, in any way, to be limitative thereof and wherein:

FIG. 4 is a perspective view of an exemplary embodiment of the package of this invention.

FIG. 5 is a perspective view of an exemplary embodiment of the package of this invention.

FIG. 6 is a perspective view of an exemplary embodiment of the package of this invention.

FIG. 7 is a perspective view showing the components of an exemplary package of the invention in unassembled position.

FIG. 8 is an end view showing the components of FIG. 7 in partially assembled position.

FIG. 9 is a side view showing the components of FIG. 7 in partially assembled position.

FIG. 10 is a side view illustrating the step of infolding and tucking the film between the abutting articles of FIGS. 7 to 9.

FIG. 11 is an end view of the components of FIG. 10.

FIG. 12 is a perspective view illustrating the package prepared using the components and steps of FIGS. 7 to 11.

FIG. 13 is a plan view of the package illustrated in FIG. 12.

Figure 1:
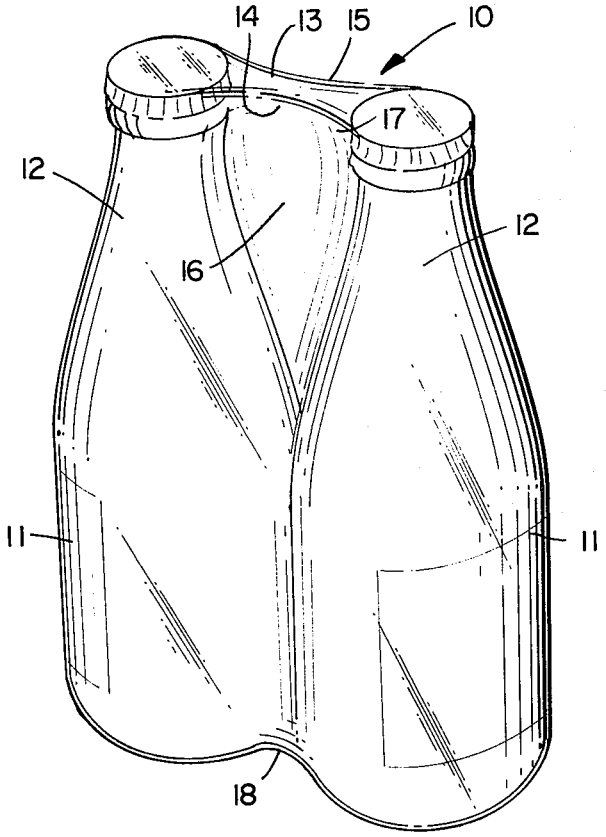
FIG. 1 is a perspective view of an exemplary embodiment of the package construction of this invention.
Figure 2:
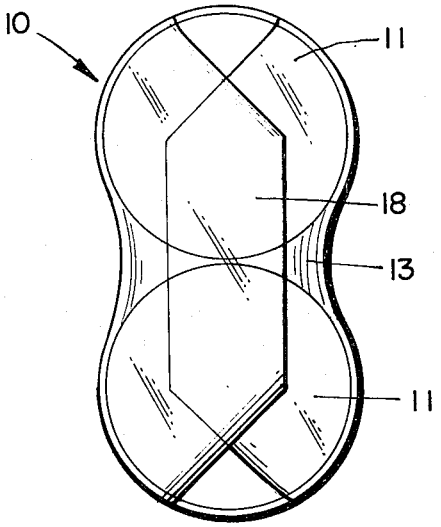
FIG. 2 is a bottom view of the package illustrated in FIG. 1.

Turning now to the drawing wherein like reference numerals denote like parts, there is shown in FIGS. 1 and 2 an exemplary embodiment of the improved package construction of the present invention designated generally as 10. The package may include two 48 ounce bottles designated as 11, each of which has a neck defining its upper end portion designated as 12. Containers having a wide variety of sizes and shapes may be used, as, for example, where the major or lower portion cross-section has a circular, oval, rectangular, hexagonal and the like configuration and a neck 12 defining the upper end portion that may be tapered, conical, cylindrical, tubular and the like configuration or combination thereof generally of smaller cross-section than the major cross-section and that may form a relatively short portion of the container or define a substantial portion thereof. Suitable containers may be, for example, glass or plastic bottles such as used with beer, soda, other beverages and food, and paper cartons such as used with milk, fruit juices and the like.

A flexible plastic film 13 closely envelops and is preferably heat-shrunk about the abutting containers 11 retaining and supporting them to provide a strong package 10. Opposite upper end portions of said film 13 are infolded and preferably tucked between the neck portions 12 of the abutting containers 11 forming reinforced integral finger grip pockets 16 and 17 for grasping and carrying the package 10. Preferably, overfolded portions 14,15 of the infolded film are fused together to further reinforce the integral finger grip pockets 16 and 17 as illustrated in FIG. 1.

The plastic film 13, which may be translucent, opaque or preferably transparent, may be prepared from any one of a variety of well-known film-forming polymers as, for example, polyvinylchloride, polyethylene, polyvinylidene chloride, polypropylene and the like. The thickness of the plastic film may be about 0.001 to 0.003 inch or greater depending on the size, weight and conformation of the container items to be packaged.

Preferably, a heat shrinkable plastic film is employed in preparing the package of the present invention so the film may be tightly drawn about the array of containers to retain them more securely. However, any flexible film that will closely envelop the array of articles as, for example, film having elastic properties may be advantageously employed.

The flexible plastic film 13 of package 10 completely envelops the array of containers, end portions 18 of said film 13 having been overlapped and fused at the bottom end of the array of bottles as illustrated in FIG. 2.

Figure 3:
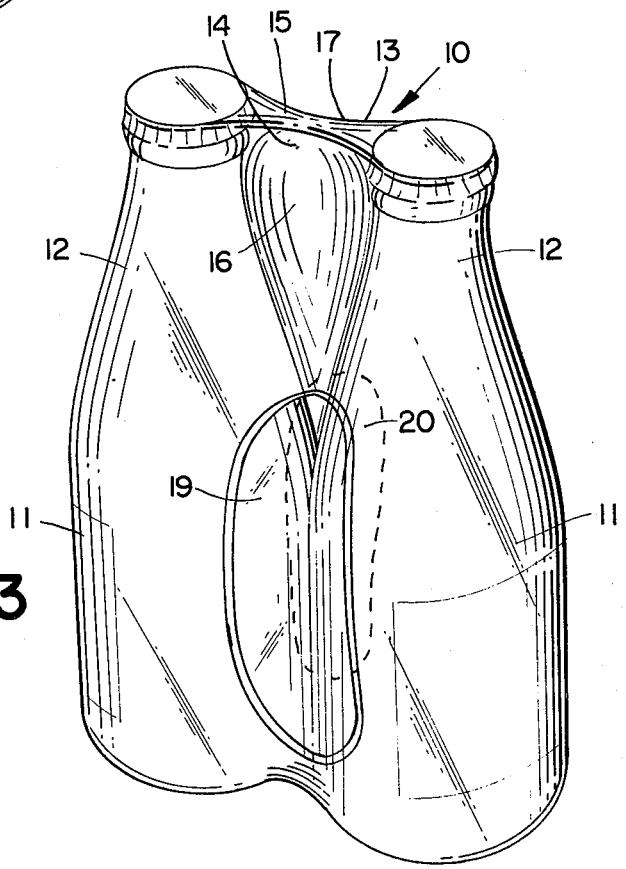
FIG. 3 is a perspective view of an exemplary embodiment of the package of this invention.

In FIG. 3 is illustrated an alternate embodiment of the package 10 of the present invention wherein the film 13 having opposed openings therein, 19 and 20, is tightly drawn about the containers 11 and reinforced, integral finger grip pockets 16 and 17 are formed from portions of the film 13 infolded between the neck portions 12 of abutting containers 11.

In FIG. 4 is illustrated another alternate exemplary embodiment wherein a plastic film 24 having elastic properties preformed into a plastic film bag shown generally as 25 having an open end 26 and having opposing infolded or "gussetted" side walls, 27 and 28, closely envelops and retains two abutting containers 21. The bag 25 has an initial girth dimension less than the girth dimension of the abutting containers and is stretched over abutting containers 21 with the film 24 being drawn tightly about the major cross-section 23 of containers 21 and draped or loosely drawn over the top of the array of bottles with the film 24 defining the open end 26 of the bag 25 being tightly drawn about the bottom ends of the bottles 21 and preferably, as illustrated in FIG. 2, completely enveloping the bottom ends of the bottles 21. The opposing infolded side walls, 27 and 28, are disposed between the necks 22 of abutting containers 21 to form reinforced integral finger grip pockets 30,31 for grasping and carrying the package.

In FIGS. 5 and 6 are illustrated other alternate exemplary embodiments, wherein in FIG. 5 the film 36 is tightly drawn about an array of three abutting bottles 35 and reinforced integral finger grip pockets 37, 38 and 39 are formed between the neck portions 40 of each of the abutting containers 35 in the package shown generally as 41, and in FIG. 6 the package shown generally as 44 comprises the film 45 tightly drawn about an array of two abutting bottles 46 and reinforced integral finger grip pockets 47,48 formed by infolding opposite upper end portions of the film 45 above the tops 49 of said abutting containers 46, as illustrated.

As is obvious, the package of the present invention may comprise an array of abutting cylindrical containers, such as cans, wherein the film may envelop and retain said array of containers with opposite upper ends of the film being infolded above the tops of the containers in the array to form finger grip pockets for grasping and carrying the package of containers that are integral with the film that retains the containers.

A method for forming the package construction of the present invention as, for example, package 10 of FIG. 1 will now be described and reference is made to FIGS. 7 to 13.

Two 48 ounce beverage bottles 50 are arranged in an abutting array. A flexible plastic film 51 preformed into a flat bag shown generally as 52 having an open end 53 is draped over the top of the array of bottles 50 and then arranged so as to completely envelop the array of bottles 50 with a skirt portion 54 adjacent the open end 53 of the bag 52 extending below the bottom ends of the bottles while leaving some slack between the closed end 55 of film bag 52 and the tops 50*a* of said bottles. Portions of the skirt 54 adjacent the open end 53 of the bag 52 are folded and overwrapped across the bottom ends of the array of bottles 50 and sealed using conventional heat sealing means or alternatively adhesively bonded (FIGS. 10, 11).

A pair of cooperating mandrel fingers 56 (FIGS. 10, 11) are urged inwardly toward the array of bottles engaging the outstanding opposite upper portions 58 and 59 of the film bag 52 infolding and tucking the film between the necks 60 of abutting bottles 50. The mandrel fingers 56 are traversed inwardly and towards each other between the necks 60 of bottles 50 to infold the opposite outstanding upper portions 58 and 59 of bag 52 forming pockets 62,63 and overfolded portions 66,67 in the top of the infolded portions of the film 51 until arriving at a desired spacing therebetween.

A blast of hot air from the "shrink gun" 61 is then directed over the entire exposed surface of film 51 causing the film to shrink and draw tightly about the containers 50 while retaining the infolded plies of film with the mandrel fingers 56 and preferably fusing together overfolded portions 66,67 of the infolded plies of film retained by the mandrel fingers 56. Alternatively, the partially completed package construction with the mandrel fingers 56 in gripping position may be passed through a heating chamber or the like wherein the heat causes heat shrinking of the film and fusing of the overfolded portions 66,67 of the infolded plies of film. After the film cools, the mandrel fingers 56 are withdrawn from within the finger grip pockets of film 62,63 between the necks 60 of containers 50. The infolded pockets of film 62,63 and particularly wherein the overlying folds of infolded film are fused together, form integral, reinforced finger gripping means for grasping and carrying the package shown generally as 65 (FIGS. 12, 13) and the package prepared as described above can be readily grasped and carried without damage to the film 51 or articles 50 retained therein.

Flexible plastic film formed into a number of alternate configurations may be suitable for use in assembly of the package of the present invention. For example, preformed bags having opposing infolded side walls such as in "gussetted bags" or preformed tubing or sleeves may also be readily and advantageously employed.

As is obvious, alternative methods may be advantageously employed in forming the package of the invention in accordance with the practice of the invention.

An array of containers as, for example, illustrated in FIGS. 1 and 2 may be inserted into a preformed plastic film bag with the bottoms of the containers in the array retained by the preformed closed end of the bag and the opposite open end thereof loosely draped about the upper end portions of said containers. The open end of the bag may then be sealed or partially sealed, for example, by heat sealing or adhesively bonding. Opposite upper end portions of the film may then be infolded between the neck portions of abutting containers and the plastic film may be heat shrunk about the containers and the overlying folds of the infolded film fused together by application of heating means.

Alternatively, an array of containers may be arranged in a tubular sleeve of film with the opposite open ends of the film tubing extending beyond the endmost articles in the array. A suitable package may be formed by infolding opposing upper end portions of the film between the necks of abutting containers, heat shrinking the film and preferably fusing together the overlying folds of the infolded plies thereof in the manner described herein to produce a package such as illustrated in FIG. 3.

The flexible plastic film as, for example, in the form of preformed bags or tubing as herein described employed in assembling the package of the invention, may envelop the desired array of articles before heating so that the film is quite snug and tightly drawn, or it may be loosely draped, or it can be snug and drawn about certain portions of the containers and fairly loose about other portions of said array depending on the type of film material, the size, weight and shape of the articles, and the desired array and method to be used in preparing the package. In any event, there must be enough film material available to enable opposite upper end portions of the film to be infolded, preferably between the upper end portions of abutting containers, to form integral reinforced finger grip pockets. Alternatively, when employing preformed bags having opposing infolded side walls, sufficient infolded film must be provided to form reinforced, integral finger grip pockets, and preferably for the overlying folds of the infolded film to be fused together in the formation of said finger grip pockets.

Accordingly, the array of containers 21 illustrated in FIG. 4 may be enveloped with a closely fitting bag shown generally as 25 having opposing infolded side walls, the bag being preformed from film material 24 having elastic properties. The bag is stretched and arranged about the array of containers to retain the same with the infolded side 27,28 walls positioned between the abutting containers 21 to form finger grip pockets 30,31 for grasping the package and the film defining the open end of the bag being tightly drawn about the bottom ends of said array of containers as illustrated, for example, in FIG. 4.

Still another package construction such as, for example, illustrated in FIG. 6 may be prepared by enveloping an array of abutting containers 46 with a flexible plastic film 45, that may be preformed into a bag or sleeve, and infolding opposite upper end portions of said enveloping film 45 above the tops 49 of the abutting containers 46 to form the finger grip pockets 47 and 48. Preferably, the package 44 is formed by then heat shrinking the film 45 and fusing together the overlying folds of the infolded plies thereof to form the integral finger grip pockets 47 and 48. Since the finger grip pockets are formed above the tops of the packaged articles, this embodiment is also applicable to articles other than bottles and the like, such as, for example, the packaging of an abutting array of cans or other cylindrical containers. Other types of containers and arrangements thereof in the package construction of the present invention will be apparent to those skilled in the art. Such construction offers definite advantages in ease of preparation and in affording a package that incorporates, for example, integral means for grasping and carrying as well as means for protecting containers in the package.

While in the foregoing specification embodiments of the invention have been set forth in considerable detail for purposes of making a complete disclosure thereof, it will be apparent to those skilled in the art that numerous changes may be made without departing from the spirit and principle of the invention.

What is claimed is:

1. A package comprising at least two containers arranged in a substantially abutting array and a flexible plastic film about and retaining said array of containers, said film having at least two opposite upper end portions having at least two opposed infolded portions, said infolded portions forming integral finger grip pockets for grasping and carrying said package.

2. The package of claim 1 wherein portions of said infolded film are fused together.

3. The package of claim 1 wherein said film completely envelops said articles.

4. The package of claim 1 wherein said containers have upper end portions of smaller cross-section.

5. The package of claim 1 wherein opposite upper end portions of said film are infolded between the upper end portions of two abutting containers in said array.

6. The package of claim 1 which comprises an array of three containers.

7. The package of claim 1 which comprises at least two opposed infolded portions of film forming finger grip pockets above the tops of containers in the array.

8. A package comprising at least two containers each having a neck defining the upper end portion thereof arranged in a substantially abutting array and a flexible plastic film bag having an open end that envelops and retains said array of containers, the closed end of said bag opposite the open end being draped over the tops of and circumferentially about the upper end portions of the containers in said array with opposite portions of the closed end and side walls of said film bag being infolded between the neck portions of at least two abutting containers in said array forming integral reinforced finger grip pockets for grasping and carrying said package.

9. The package of claim 8 wherein said flexible film is elastic.

10. The package of claim 8 wherein overfolded portions of said infolded film are fused together.

* * * * *